United States Patent [19]

Urbani

[11] Patent Number: 4,672,710

[45] **Date of Patent: * Jun. 16, 1987**

[54] SINGLE PRESSURE VESSEL CLEANING SYSTEM

[75] Inventor: William G. Urbani, Stockton, Calif.

[73] Assignee: Industrial Innovations, Inc., Stockton, Calif.

[ * ] Notice: The portion of the term of this patent subsequent to Aug. 21, 2001 has been disclaimed.

[21] Appl. No.: 767,004

[22] Filed: Aug. 19, 1985

[51] Int. Cl.[4] ..... B08B 9/08

[52] U.S. Cl. ..... 15/302; 134/104; 134/111; 210/195.3; 210/332

[58] Field of Search ..... 134/10, 104, 109, 110, 134/111, 167 R, 166 R, 168 R, 186; 210/257.1, 332, 195.1, 167, 195.3; 15/302, 340

[56] References Cited

U.S. PATENT DOCUMENTS

| | | | |
|---|---|---|---|
| 2,139,096 | 12/1938 | Piquerez . | |
| 2,834,359 | 5/1958 | Kearney . | |
| 2,860,785 | 11/1958 | Gardner | 210/195.1 |
| 3,046,163 | 7/1962 | Kearney et al. | 134/11 |
| 3,140,828 | 7/1964 | Galanor | 134/109 |
| 3,447,545 | 6/1969 | Lawter . | |
| 3,477,178 | 11/1969 | Hulbert, Jr. | 134/167 R |
| 3,502,215 | 3/1970 | Cahan | 210/167 |
| 3,565,252 | 2/1971 | Sheehy . | |
| 4,134,174 | 1/1979 | Flynn et al. . | |
| 4,466,154 | 8/1984 | Urbani | 15/302 |
| 4,530,131 | 7/1985 | Zell et al. . | |

OTHER PUBLICATIONS

Oliver, J. T., Western Electric Technical Digest No. 37, pp. 19–20, Jan. 1975.

*Primary Examiner*—Harvey C. Hornsby
*Assistant Examiner*—Frankie L. Stinson
*Attorney, Agent, or Firm*—Townsend and Townsend

[57] ABSTRACT

A cleaning system includes a pressure vessel partially filled with a cleaning liquid which is pumped from the vessel, heated by a heat exchanger and sprayed onto a dirty surface to be cleaned. A vacuum pump creates a partial vacuum above the free surface of the cleaning liquid in the vessel. A vacuum line connects a low point at the dirty surface to the pressure vessel so that dislodged contaminants and cleaning liquid are sucked into the vessel. Liquid and solids are pumped from the pressure vessel into a solids separator to remove relatively large solids. Liquid passes from the solid separator into a centrifuge which removes very fine solid particles, which are combined with a bulk solidification medium in a blender/extruder to create disposal cake. Exhaust gases from the vacuum pump can be either recycled into a substantially sealed dirty tank or directed through a scrubber to remove condensate and other substances. The exhaust gas from the scrubber can be burned in the heat exchanger burner.

18 Claims, 1 Drawing Figure

SINGLE PRESSURE VESSEL CLEANING SYSTEM

BACKGROUND OF THE INVENTION

The invention is related to cleaning systems, in particular one which is suited for cleaning heavily soiled surfaces, particularly tanks, vats and other containers.

Many industrial containers, including truck tankers, railroad tank cars and stationary tanks and vats, must be cleaned, usually after the tank is empty, to remove any material or contaminants left on the container surfaces. To do so, the surfaces to be cleaned are usually sprayed with a high pressure cleaning liquid to dislodge the contaminants, both liquid and solid, from the surfaces. Because the impact of the high pressure spray is diffused if there is a liquid layer within the tank, it is desirable to keep the amount of cleaning liquid which gathers at the bottom of the tank to a minimum. This is preferably done by constantly removing the cleaning liquid and dislodged contaminants.

The cleaning liquid and dislodged contaminants may both be liquid. However, the mixture is often a sludge containing liquids, viscous materials and solids. Some type of containers, such as oil tankers, pose special problems for tank cleaning apparatus. Oil pumped out of the ground contains rocks, sand and gravel. In addition to this naturally occurring foreign matter, a great number of rags find their way into oil holding compartments of oil tankers. The presence of contaminants which both float and sink create additional problems during cleaning operations. What has been missing from the prior art is a mobile processing multi-component sludge.

SUMMARY OF THE INVENTION

The invention is directed to a cleaning system wherein cleaning liquid, stored in a pressure vessel, is sprayed onto a dirty surface, typically in a tank, vat or other container. The cleaning liquid is stored in a pressure vessel and incompletely fills the vessel so that a space is left above the free surface of the liquid in the upper region of the pressure vessel. A vacuum is created within the space above the free surface by a vacuum pump. A pressure pump draws cleaning liquid from the vessel and forces the liquid through a pressure line to a heat exchanger. The cleaning liquid is heated as it passes through the heat exchanger and then passes through a line where the high pressure, high temperature liquid is used to clean inside the tank.

Simultaneously with the spraying of high pressure, high temperature cleaning liquid onto the dirty surface, a vacuum line draws the sprayed cleaning liquid and dislodged contaminants from a low point at or near the dirty surface, such as at the bottom of a tank. The other end of the vacuum line terminates at the upper region of the pressure vessel so the cleaning liquid and contaminants from the dirty surface are sucked into the pressure vessel. In this way, cleaning liquid and contaminants withdrawn from the tank never pass through the vacuum pump.

The invention is especially adapted for use when solid contaminants are plentiful. It uses a single main vessel which combines the functions of a solids separator vessel and a pressure vessel. When used to clean a dirty tank which can be substantially sealed, the system can be operated as a closed loop so no gases are allowed to escape into the atmosphere. This is accomplished by connecting the exhaust from the vacuum pump to the dirty tank being cleaned. Alternatively, a scrubber assembly, to remove selected substances from the vacuum pump exhaust, can be used to help prevent air pollution. When the heat exchange includes a burner, the gases exiting the scrubber can be directed to the air inlet of the burner where they are burned. The exhaust from the scrubber can also be exhausted to atmosphere or returned to the dirty tank.

Both liquid and solids of a range of sizes are passed from the pressure vessel to a solids separator which removes the larger solids, such as rocks and rags, for disposal. The liquid from the solids separator is directed to a centrifuge which effectively removes fine solid particles from the remaining liquid; the centrifuged liquid is returned to the pressure vessel. The fine solids removed by the centrifuge are preferably combined with a bulk solidification medium in a blender/extruder for creating disposal cake.

In addition to removing finely divided solids from the cleaning liquid, centrifuging the liquid also aids the natural separation of oil from the non-oily liquids in the pressure vessel. Such oil separation is also aided by keeping the pressure vessel at a partial vacuum which lowers the boiling point of the cleaning liquid. It has been found that the tiny bubbles, which form in the cleaning liquid at such reduced pressures and elevated temperatures, aid oil separation. The oil layer can be removed in a variety of ways, such as by a floating oil skimmer or by a standpipe.

Another advantage of the invention acrues through the use of an isolated vacuum pump for sucking up the cleaning liquid and contaminants from the bottom of the tanks. The vacuum pump, being isolated from any flow of liquids or solids, operates relatively independently of the amount of size of dirt and abrasives and also the amount of air which may be sucked in along with the liquids and solids. Therefore, a relatively high suction force can be maintained to ensure that the bottom of the tank being cleaned is substantially free from puddles of cleaning liquid. Therefore, pump life and cleaning efficiency are both increased. Also, because the vacuum pump operates effectively when a substantial amount of air is sucked through the vacuum line along with the cleaning liquid and contaminants, gases are prevented from escaping from tanks which are not sealed. This is a distinct advantage when the emissions are noxious or toxic to the personnel who must operate the spraying equipment at the opening in the tank.

A further advantage of the invention is its mobility. By mounting the apparatus to a trailer or other vehicle the cleaning system can be moved to the tanks to be cleaned. Railroad tank cars can be cleaned almost anywhere while tanks on ships can be cleaned while docked along a wharf or pier.

Other features and advantages of the present invention will be apparent from the following description in which the preferred embodiment is set forth in detail in conjunction with the accompanying drawing.

DETAILED DESCRIPTION OF THE PREFERRED EMBODIMENT

Figure 1:
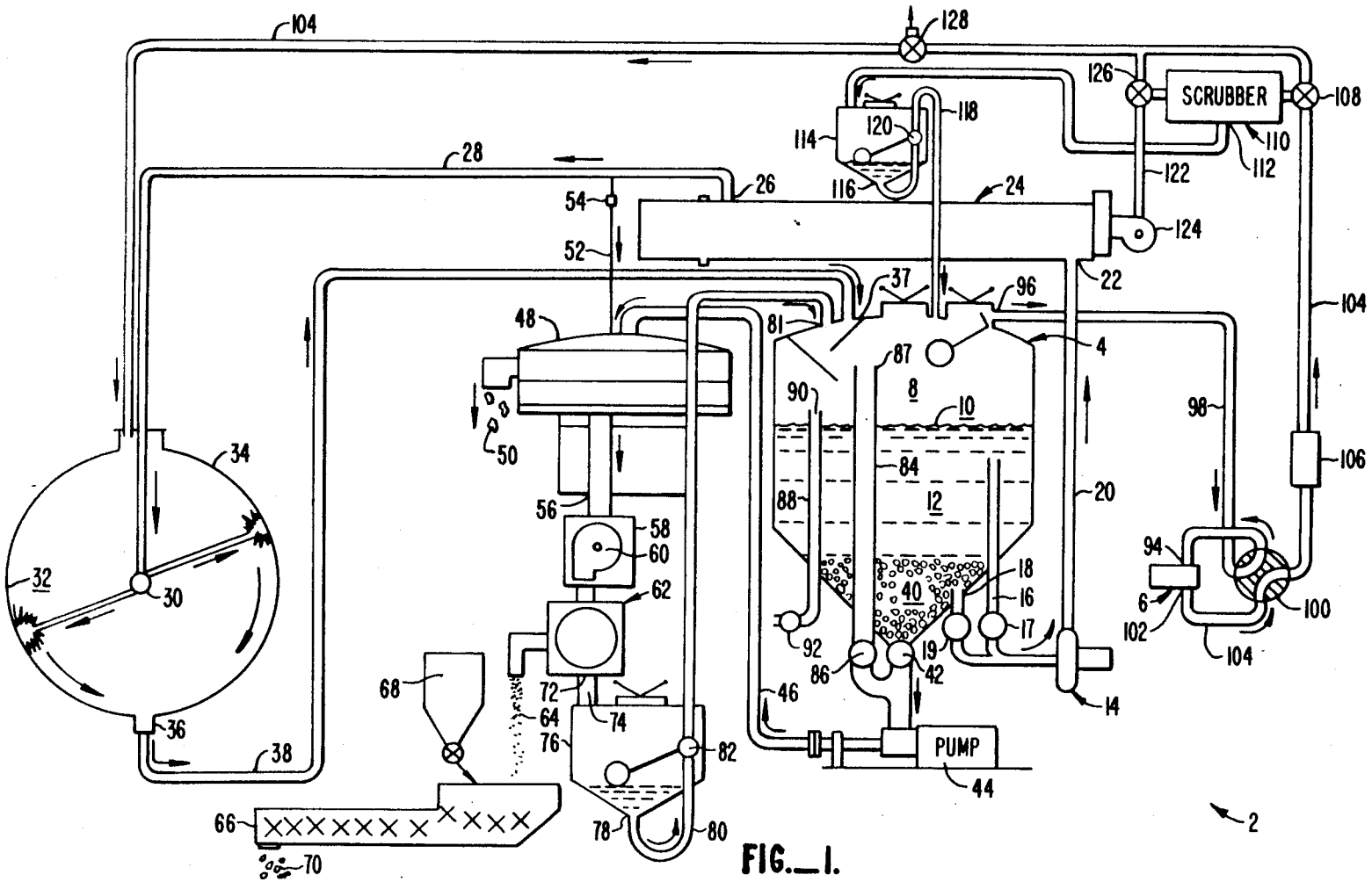
FIG. 1 is a schematic representation of the preferred embodiment of the invention.

Turning now to FIG. 1, cleaning system 2 is shown to include a pressure vessel 4 connected to a vacuum pump 6 which draws a partial vacuum within a vacuum space 8 above the free surface 10 of cleaning liquid 12 within vessel 4. A pressure pump 14 is connected to the interior of pressure vessel 4 by a pair of liquid inlet pipes 16, 18 through valves 17, 19 for pumping cleaning liquid through a pipe 20 into an inlet 22 of a heat exchanger 24.

Heat exchanger 24 includes an outlet 26 through which heated cleaning liquid 12 at about 180° F. is pumped through a line 28 and through a sprayer 30 to be sprayed against a dirty surface 32 of a dirty tank 34. Tank 34 includes a drain 36 which is coupled to vacuum space 8 within pressure vessel 4 at a suction inlet 37 by a vacuum line 38. Therefore, the partial vacuum within space 8 sucks cleaning liquid and dislodged contaminants, both solid and liquid, from dirty tank 34 for deposit into vessel 4.

Solid material collects in a lower region 40 of main vessel 4. Liquid and solid material pass through a valve 42 and are pumped by a pump 44 through a solids/liquids discharge line 46 into a solids separator 48. Solids separator 48 removes the larger solids 50 for disposal. If desired, additional cleaning liquid 12 can be introduced into solids separator 48 through a supplementary high pressure line 52 by manipulating a valve 54. Liquid from solids separator passes from a liquid outlet 56 of solids separator 48 and into a collector tank 58 where it is pumped from tank 58 by a pump 60 into a centrifuge 62. Very fine solids 64 are removed by centrifuge 62 and are directed into a blender/extruder 66 where fine solids 64 are mixed with a bulk solidification medium 68 to create disposal cake 70 for convenient disposal.

Liquid from centrifuge 62 passes from a liquid outlet 72 through a line 74 and into a liquid collector 76. Liquid passes from collector 76 through an outlet 78 and a liquid suction line 80 which opens into vacuum space 8 of pressure vessel 4 at a suction inlet 81. A shut-off valve 82 is mounted along line 80 and closes line 80 whenever the liquid level within collector 76 falls below a predetermined level.

To remove any accumulation of rags or other floating debris, a floating solids removal pipe 84 is connected to pump 44 through a valve 86. When floating debris reaches the level of the upper end 87 of pipe 84, valve 86 is opened, allowing pump to pump the floating debris from vessel 4 for separation by solids separator 48.

A decanting pipe 88 having an open upper end 90 and controlled by a shut-off valve 92 is used to remove any liquid 12 above its open upper end 90 to maintain free surface 10 at or below the upper end. This may be necessary when dirty tank 34 has a relatively large quantity of liquid in it before being cleaned. Also, decanting pipe 88 can be used to skim any oil at free surface 10. Alternatively, an oil skimmer having an inlet which floats at free surface 10 can be used to skim any oil or oily residue.

Vacuum pump 6 includes an inlet 94 connected to a vacuum outlet 96 in pressure vessel 4 through a line 98 passing through a four-way valve 100. Pump 6 includes a pump outlet 102 connected to a line 104 which also passes through four-way valve 100. A muffler 106 is placed along line 104 to reduce the exhaust noise. Line 104 connects vacuum pump 6 with dirty tank 34 so that the system can be operated as a closed loop.

A diverter valve 108 is positioned along line 104 to direct the exhaust from vacuum pump 106 to a conventional scrubber 110. Scrubber 110, which can be a single unit or a number of units coupled together, removes various components from the exhaust, particularly condensable liquids; such condensed liquids leave scrubber 110 via a liquid exit 112 for collection in liquid collector 114. Liquid collector 114 includes a liquid outlet 116 connected to pressure vessel 4 at vacuum space 8 by a line 118. When the liquid level within collector 14 is sufficiently high to open a shutoff valve 120, liquid collected therein is sucked into vessel 4. In addition to condensing liquids, other conventional substance removal techniques and apparatus can be used in scrubber 110. For example, a carbon pack can be used to remove various substances from the exhaust.

The remaining exhaust is directed from scrubber 110 through a diverter valve 126 in an exhaust line 122 for introduction into the combustion chamber of a burner 124 of heat exchanger 24. Alternatively, the exhaust can be directed back to line 104 by valve 126 where it can be exhausted to atmosphere through a diverter valve 128 or back into dirty tank 34. Diverter valves 108, 128 allow the user to vent the exhaust from pump 6 directly to atmosphere when desired.

In use, assuming there is no appreciable sediment in lower region 40 of vessel 4, valves 42, 86 and 54 will be closed. Vacuum pump 6 will pull a partial vacuum within space 8 causing solids, liquids and gases within dirty tank 34 to be pulled through outlet 36 and into vessel 4 through suction inlet 37. Meanwhile, pump 14 pumps cleaning liquid 12 from vessel 4 through line 20, through heat exchanger 26, line 28 and out sprayer 30 so that the cleaning liquid impacts on dirty surface 32. To ensure that undesirable gases and vapors are not released to the atmosphere, the exhaust from pump 6 is pumped through four-way valve 100, line 104 and back into dirty tank 34. If it is desired to scrub the exhaust gases, valve 108 is manipulated so that the exhaust passes through scrubber 110 so that condensable liquids are returned to vessel 4; the remaining exhaust gases are either vented to atmosphere through valve 128, recycled to tank 34 or burned in burner 124 by the appropriate manipulation of valves 126, 128.

When solids are present in vessel 4, valve 42, and valve 54 if necessary, is opened and pump 44 is actuated pumping a solids/liquids mixture through pipe 46 and into solids separator 48. Large solids 50 are removed by solids separator 48 while liquid from solid separator 48 is pumped into centrifuge 62 for the removal of fine solids 64 by the centrifuge. Fine solids 64 are combined with bulk solidification medium 68 to produce disposal cake 70 by blender/extruder 66. The centrifuged liquid passes into liquid collector 76. When sufficient liquid has been collected so that shutoff valve 82 is opened, the partial vacuum within space 8 pulls the liquid from collector 76 through liquid suction line 80 and into tank 4.

To remove floating solids, liquid level 10 is allowed to rise until the solids begin to be pulled through the open upper end of pipe 84, valve 86 being opened. To remove excess liquid or to skim oil, valve 92 is opened allowing oil or other liquid at free surface 10 to pass through decanting pipe 88 for disposal or processing.

The present invention is particularly suited for cleaning containers such as tanks. However, it can also be used for cleaning areas where liquid is sprayed onto a surface and can be collected at a low point. For example, certain rooms or buildings may be amenable for cleaning by the apparatus of the invention.

Modification and variation can be made to the disclosed embodiment without departing from the subject of the invention as defined by the following claims. For example, depending upon the circumstances it may be desired to augment the suction along line 38 with a pump.

What is claimed is:

1. A cleaning system comprising:

a substantially sealed pressure vessel having a liquid outlet, a vacuum outlet and a suction inlet in fluid communication with the interior of said vessel, said vacuum outlet and said suction inlet communicating with an upper region of said vessel and said liquid outlet communicating with a lower region of said vessel;

first pump means, fluidly connected to said liquid outlet, for pumping a cleaning liquid from said vessel through a first line, said liquid partially filling said pressure so that said vacuum outlet is above the free surface of said cleaning liquid;

vacuum means, fluidly connected to said vacuum outlet, for drawing a partial vacuum within said upper region of said pressure vessel;

solids separator means, including a liquid outlet, for removing solids from a mixture of solids and liquids;

pipe means for fluidly connecting an inlet of said solids separator means to said vessel, said pipe means adapted to pass a mixture of solids and said cleaning liquid from said vessel to said solids separator means; and a centrifuge having a centrifuge inlet fluidly connected to the solids separator means liquid outlet, a fine solids outlet and a centrifuge liquid outlet, the centrifuge liquid outlet fluidly coupled to the interior of said vessel for passage of liquid from said centrifuge liquid outlet into said vessel.

2. The cleaning system of claim 1 further comprising a bulk solidification medium source and a blender/extruder means, operably connected to the fine solids outlet and the bulk solidification medium source, for creating disposal cake.

3. The cleaning system of claim 1 further comprising a pump between the solids separator means liquid outlet and the centrifuge inlet.

4. The cleaning system of claim 3 wherein said pipe means includes means for selectively communicating with said upper and lower regions said vessel.

5. The cleaning system of claim 1 further comprising a liquid collector for temporarily storing liquid between the centrifuge liquid outlet and the interior of said vessel.

6. The cleaning system of claim 5 wherein the liquid collector has a collector outlet fluidly connected to said upper region of said pressure vessel.

7. The cleaning system of claim 1 further comprising an exhaust scrubber, fluidly connected to an exhaust outlet of the vacuum means, for removing selected components of the vacuum means exhaust.

8. The cleaning system of claim 7 wherein the exhaust scrubber includes a liquid outlet, coupled to the pressure vessel, and a gas outlet.

9. The cleaning system of claim 8 further comprising a liquid heater, including a burner, through which said cleaning liquid flows, and wherein said scrubber gas outlet is fluidly coupled to a combustion air inlet of said burner to to burn the gas from the exhaust scrubber.

10. The cleaning system of claim 1 including second pump means for pumping said mixture of solids and cleaning fluid from said vessel to said solids separator means inlet.

11. The cleaning system of claim 1 wherein said pipe means communicates with a bottom portion of said lower region of said vessel.

12. The cleaning system of claim 1 further comprising a second line fluidly connected to said vessel upper region at one end to provide a source of suction at the other end of said second line, said other end fluidly connected to the centrifuge liquid outlet.

13. The cleaning system of claim 1 further comprising means, fluidly connected to said first line, for directing said cleaning liquid to said object to be cleaned to dislodge contaminants from said object.

14. The cleaning system of claim 1 further comprising a liquid heater positioned along said first line to heat said cleaning liquid passing through said first line.

15. A cleaning system comprising:

a substantially sealed pressure vessel having a liquid outlet, a vacuum outlet and a suction inlet in fluid communication with the interior of said vessel, said vacuum outlet and said suction inlet communicating with an upper region of said vessel and said liquid outlet communicating with a lower region of said vessel;

first pump means, fluidly connected to said liquid outlet, for pumping a cleaning liquid from said vessel through a first line, said liquid partially filling said pressure vessel so that said vacuum outlet and suction inlet are above the free surface of said cleaning liquid;

vacuum means, fluidly connected to said vacuum outlet and having an exhaust outlet, for drawing a partial vacuum within said upper region of said pressure vessel;

solids separator means for removing solids from a mixture of solids and liquids;

pipe means for fluidly connecting an inlet of said solids separator means to said vessel, said pipe means adapted to pass a mixture of solids and said cleaning liquid from said vessel to said solids separator means;

said solids separator means including a liquid outlet fluidly coupled to the interior of said vessel for drawing liquid from said solids separator means into said vessel; and an exhaust scrubber, for removing selected components of the exhaust from the vacuum means, including a scrubber inlet connected to the exhaust outlet, a liquid outlet connected to the pressure vessel and a gas outlet.

16. The cleaning system of claim 15 further comprising a liquid heater, including a burner, through which said cleaning liquid flows, and wherein said gas outlet is fluidly coupled to a combustion air inlet of said burner to to burn the gas from the exhaust scrubber.

17. A tank cleaning system comprising:

a tank to be cleaned;

a substantially sealed pressure vessel having a liquid outlet, a vacuum outlet and first and second suction inlets in fluid communication with the interior of said vessel, said vacuum outlet and said first and second suction inlets communicating with an upper region of said vessel interior and said liquid outlet communicating with a lower region of said vessel interior;

first pump means, fluidly connected to said liquid outlet, for pumping a cleaning liquid from said vessel through a first line, said liquid partially filling said pressure vessel so that said vacuum outlet and suction inlets are above the free surface of said cleaning liquid;

vacuum means, fluidly connected to said vacuum outlet, for drawing a partial vacuum within said pressure vessel;

means for heating said cleaning liquid passing through said first line;

means, fluidly connected to said first line, for directing said liquid cleaner at the interior of the tank to be cleaned thereby dislodging contaminants therefrom;

a second line fluidly connected to said second suction inlet at one end and to the interior of the tank at its other end whereby the partial vacuum within said vessel produces suction at said other end to suck said liquid cleaner and dislodged contaminants from the tank into said vessel;

solids separator means, including a liquid outlet, for removing solids from a mixture of solids and liquids;

pipe means for fluidly connecting an inlet of said solids separator means to said vessel, said pipe means adapted to pass a mixture of solids and said cleaning liquid from said vessel to said solids separator means;

a centrifuge having a centrifuge inlet fluidly connected to the solids separator means liquid outlet, a fine solids outlet and a centrifige liquid outlet, the centrifuge liquid outlet fluidly coupled to the upper region of said vessel interior for passage of liquid from said centriguge liquid outlet into said vessel; and a blender/extruder means, operably connected to the fine solids outlet and a source of bulk solidification medium, for creating disposal cake.

18. The cleaning system of claim 17 wherein said vacuum means includes a vacuum pump having an inlet coupled to said vacuum outlet of said vessel and an outlet coupled to the tank so that said cleaning system is a substantially closed system.

* * * * *